US011492218B2

(12) United States Patent
Okazaki

(10) Patent No.: US 11,492,218 B2
(45) Date of Patent: Nov. 8, 2022

(54) SHEET SUPPORTING APPARATUS AND IMAGE FORMING APPARATUS

(71) Applicant: CANON KABUSHIKI KAISHA, Tokyo (JP)

(72) Inventor: Shunsuke Okazaki, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 237 days.

(21) Appl. No.: 16/733,503

(22) Filed: Jan. 3, 2020

(65) Prior Publication Data

US 2020/0239255 A1 Jul. 30, 2020

(30) Foreign Application Priority Data

Jan. 24, 2019 (JP) ..... JP2019-010374

(51) Int. Cl.
*B65H 1/04* (2006.01)

(52) U.S. Cl.
CPC ..... *B65H 1/04* (2013.01); *B65H 2402/64* (2013.01); *B65H 2403/411* (2013.01); *B65H 2511/10* (2013.01); *B65H 2511/12* (2013.01); *B65H 2511/20* (2013.01)

(58) Field of Classification Search
CPC ..... B65H 2511/10; B65H 2511/12; B65H 2403/411; B65H 2402/64; B65H 1/04
See application file for complete search history.

(56) References Cited

U.S. PATENT DOCUMENTS

| | | | | |
|---|---|---|---|---|
| 8,002,270 | B2 * | 8/2011 | Blair | B65H 1/00 271/171 |
| 8,052,141 | B2 * | 11/2011 | Yamagishi | B65H 1/266 271/171 |
| 9,580,258 | B1 * | 2/2017 | McFarland | B65H 1/266 |
| 9,701,493 | B2 * | 7/2017 | Sato | B65H 1/266 |
| 9,840,382 | B2 | 12/2017 | Okazaki et al. | |
| 10,233,041 | B2 | 3/2019 | Okazaki et al. | |
| 2016/0001995 | A1 | 1/2016 | Sato | |

FOREIGN PATENT DOCUMENTS

| | | | |
|---|---|---|---|
| JP | 2009-73574 | A | 4/2009 |
| JP | 2016-13894 | A | 1/2016 |
| JP | 2016-141494 | A | 8/2016 |

* cited by examiner

*Primary Examiner* — Jeremy R Severson
(74) *Attorney, Agent, or Firm* — Venable LLP

(57) ABSTRACT

A sheet supporting apparatus includes a positioning device to position a regulating portion to a sheet support. The positioning device includes a first group of teeth provided on the sheet support, a second group of teeth disposed at a position different from the first group of teeth provided on the sheet support, a third group of teeth provided on a regulator and capable of transiting to a first state of engaging with the first group of teeth and to a second state of engaging with less area of the first group of teeth than that in the first state, and a fourth group of teeth provided on the regulator and capable of transiting to a third state of engaging with the second group of teeth and to a fourth state of engaging with less area of the second group of teeth than that in the third state.

13 Claims, 14 Drawing Sheets

(b)

SHEET SUPPORTING APPARATUS AND IMAGE FORMING APPARATUS

BACKGROUND OF THE INVENTION

Field of the Invention

The present invention relates to a sheet supporting apparatus configured to support a sheet and to an image forming apparatus including the same.

Description of the Related Art

Hitherto, a sheet guiding apparatus including a bottom plate on which a sheet is stacked and first and second edge guides configured to regulate a widthwise position orthogonal to a feed direction of the sheet stacked on the bottom plate has been proposed as disclosed in Japanese Patent Application Laid-open No. 2009-73574 for example. The first and second edge guides are configured to be interlocked with each other. The first edge guide includes a movable-piece-side first lock teeth portion and a movable-piece-side second lock teeth portion engageable respectively with two rows of a bottom-plate-side first lock teeth portion and a bottom-plate-side second lock teeth portion provided on the bottom plate.

The bottom-plate-side first lock teeth portion and the bottom-plate-side second lock teeth portion have a plurality of teeth arrayed with a predetermined pitch and are arrayed so as to be shifted from each other by a length of a half pitch. A plurality of teeth arrayed with a predetermined pitch in the movable-piece-side first lock teeth portion and the movable-piece-side second lock teeth portion are arranged without being shifted from each other. Due to that, when the first edge guide is locked by the bottom plate, only either one of the movable-piece-side first lock teeth portion and the movable-piece-side second lock teeth portion engages with one of the bottom-plate-side first lock teeth portion and the bottom-plate-side second lock teeth portion.

In the first edge guide described in Japanese Patent Application Laid-open No. 2009-73574 however, the movable-piece-side second lock teeth portion is raised by being pressed by the bottom-plate-side second lock teeth portion in a condition in which the movable-piece-side first lock teeth portion engages with the bottom-plate-side first lock teeth portion. Due to that, the entire first edge guide tilts and a force acting in a direction of raising not only the movable-piece-side second lock teeth portion but also the movable-piece-side first lock teeth portion from the bottom-plate-side first lock teeth portion. Accordingly, the first edge guide is insufficiently locked to the bottom plate and there is a possibility that the first edge guide unintentionally moves and disturbs alignment of the sheet.

Accordingly, the present disclosure aims at providing a sheet supporting apparatus solving the abovementioned problems by firmly positioning a regulating portion to a sheet supporting unit and an image forming apparatus including the same.

SUMMARY OF THE INVENTION

According to one aspect of the present invention, a sheet supporting apparatus includes a sheet supporting portion configured to support a sheet, a regulating portion movably supported by the sheet supporting portion and configured to regulate a position of the sheet supported by the sheet supporting portion, and a positioning unit configured to position the regulating portion to the sheet supporting portion, wherein the positioning unit includes a first teeth portion provided on the sheet supporting portion, the first teeth portion having a plurality of teeth arranged along a moving direction of the regulating portion, a second teeth portion disposed at a position different from the first teeth portion in an orthogonal direction orthogonal to the moving direction and provided on the sheet supporting portion, the second teeth portion having a plurality of teeth arranged along the moving direction, a third teeth portion provided on the regulating portion and being capable of transiting to a first state of engaging with the first teeth portion and to a second state of engaging with less area of the first teeth portion than that in the first state, a fourth teeth portion provided on the regulating portion and being capable of transiting to a third state of engaging with the second teeth portion and to a fourth state of engaging with less area of the second teeth portion than that in the third state, and an operating portion configured to cause a force which the fourth teeth portion receives from the second teeth portion to act as a force in a direction in which the third teeth portion engages with the first teeth portion in a case where the third teeth portion is in the first state and the fourth teeth portion is in the fourth state, and configured to cause a force which the third teeth portion receives from the first teeth portion to act as a force in which the fourth teeth portion engages with the second teeth portion in a case where the fourth teeth portion is in the third state and the third teeth portion is in the second state.

Further features of the present invention will become apparent from the following description of exemplary embodiments with reference to the attached drawings.

DESCRIPTION OF THE EMBODIMENTS

First Embodiment

Entire Configuration

A printer of a first embodiment of the present disclosure will be described with reference to FIG. 1. The printer 1 serving as an image forming apparatus is an electro-photographic laser beam printer configured to form a monochrome toner image. Note that a sheet S in the following description is what an image is formed thereon by the printer 1 and includes a sheet of paper, an OHT sheet and others for example.

Figure 1:
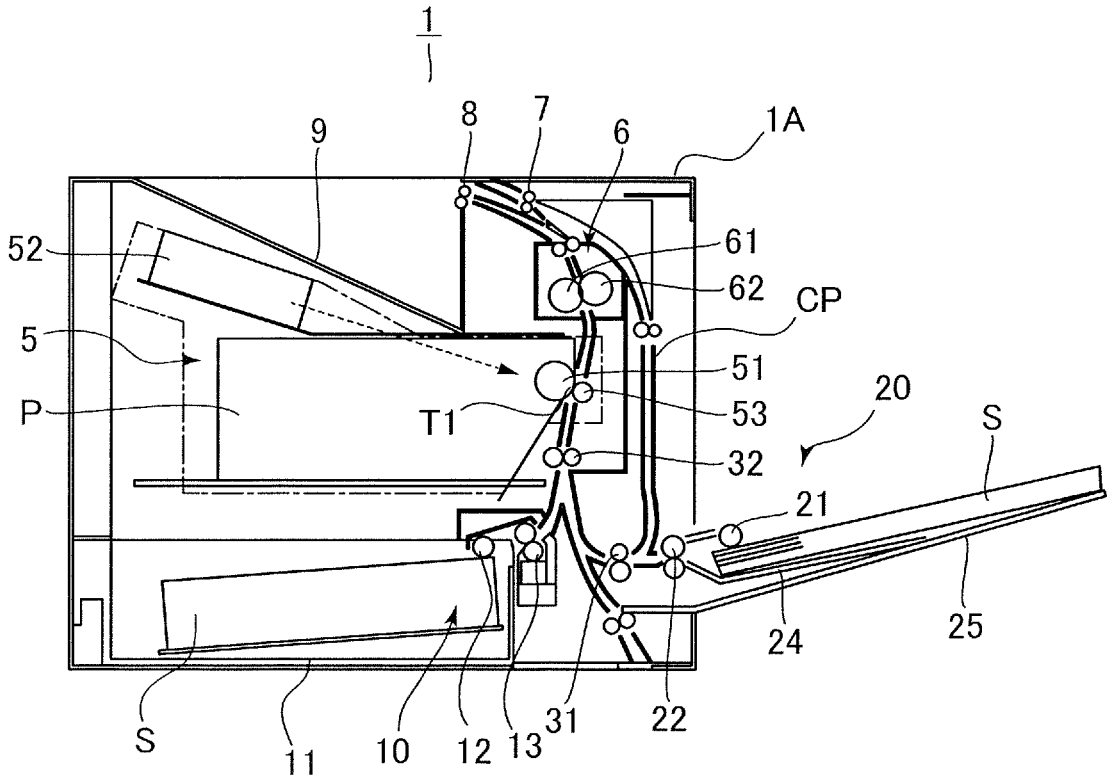
FIG. 1 is a schematic diagram illustrating an entire configuration of a printer of a first embodiment of the present disclosure.

As illustrated in FIG. 1, the printer 1 includes a body feed unit 10 and a manual feed unit 20 respectively configured to feed a stacked sheet. The printer 1 also includes an image forming unit 5 configured to form an image on the sheet fed by the body feed unit 10 or the manual feed unit 20, a fixing unit 6 configured to fix an image transferred onto the sheet and a discharge roller pair 8 capable of discharging the sheet to a discharge tray 9.

As an image forming job is inputted to the printer 1, the image forming unit 5 starts an image forming process based on image information inputted from an external computer or the like connected to the printer 1. The image forming unit 5 includes a laser scanner 52, a process cartridge P including a photosensitive drum 51 and a transfer roller 53. Provided around the photosensitive drum 51 are a charging roller, a developing roller and others not illustrated. The photosensitive drum 51 and the transfer roller 53 form a transfer nip T1.

The laser scanner 52 irradiates the photosensitive drum 51 with a laser beam based on the inputted image information. At this time, because the photosensitive drum 51 has been charged in advance by the charging roller, an electrostatic latent image is formed on the photosensitive drum 51 as the photosensitive drum 51 is irradiated with the laser beam. Then, the electrostatic latent image is developed by the developing roller and a monochrome toner image is formed on the photosensitive drum 51.

In parallel with the abovementioned image forming process, the sheet S is fed from the body feed unit 10 or the manual feed unit 20. The body feed unit 10 includes a cassette 11 drawable and attachable to an apparatus body 1A, a feed roller 12 and a separation roller pair 13. The sheet S stored in the cassette 11 is fed by the feed roller 12, and the sheet S fed by the feed roller 12 is separated one by one by the separation roller pair 13. The manual feed unit 20 serving as a sheet supporting apparatus includes a manual feed tray 24 supported by a cover 25 pivotably supported by the apparatus body 1A, a feed roller 21 and a separation roller pair 22. The sheet S supported by the manual feed tray 24 serving as the sheet supporting portion is fed by the feed roller 21 and the sheet S fed by the feed roller 21 is separated one by one by the separation roller pair 22.

Note that the cassette 11 or the manual feed tray 24 may be provided with a middle plate that is capable of supporting and lifting the sheet. That is, the middle plate may be lifted up along with an input of an image forming job to bring the sheet supported by the middle plate into contact with the feed roller. Still further, in terms of the separation roller pairs 13 and 22, one of the rollers may be a pad or the like and a torque limiter type or a retard roller type separation roller pair is also applicable.

The sheet S is delivered out of the body feed unit 10 or the manual feed unit 20 and is conveyed by a conveyance roller pair 32 to the transfer nip T1. Then, the toner image on the photosensitive drum 51 is transferred onto the sheet at the transfer nip T1 by an electrostatic load bias applied to the transfer roller 53. Residual toner left on the photosensitive drum 51 is collected by a cleaning blade (not illustrated). The sheet S onto which the toner image has been transferred is conveyed to the fixing unit 6 to undergo predetermined heat and pressure applied by a fixing film 61 and a pressure roller 62 of the fixing unit 6 to melt and adhere, i.e., to fix the toner. A heating member such as a ceramic heater is disposed within the fixing film 61. The sheet S which has passed through the fixing unit 6 is discharged by the discharge roller pair 8 to the discharge tray 9.

In a case of forming images on both sides of the sheet S, the sheet S on which the image has been formed on a first surface thereof is switched back by a reversing roller pair 7 to convey to a duplex conveyance path CP. The duplex conveyance path CP guides the sheet S to the conveyance roller pair 31. Then, the sheet S is conveyed by the conveyance roller pairs 31 and 32 to the transfer nip T1 again to form the other image on a second surface thereof at the transfer nip T1 and is then discharged out to the discharge tray 9.

Detailed Configuration Manual Feed Portion

Figure 2:
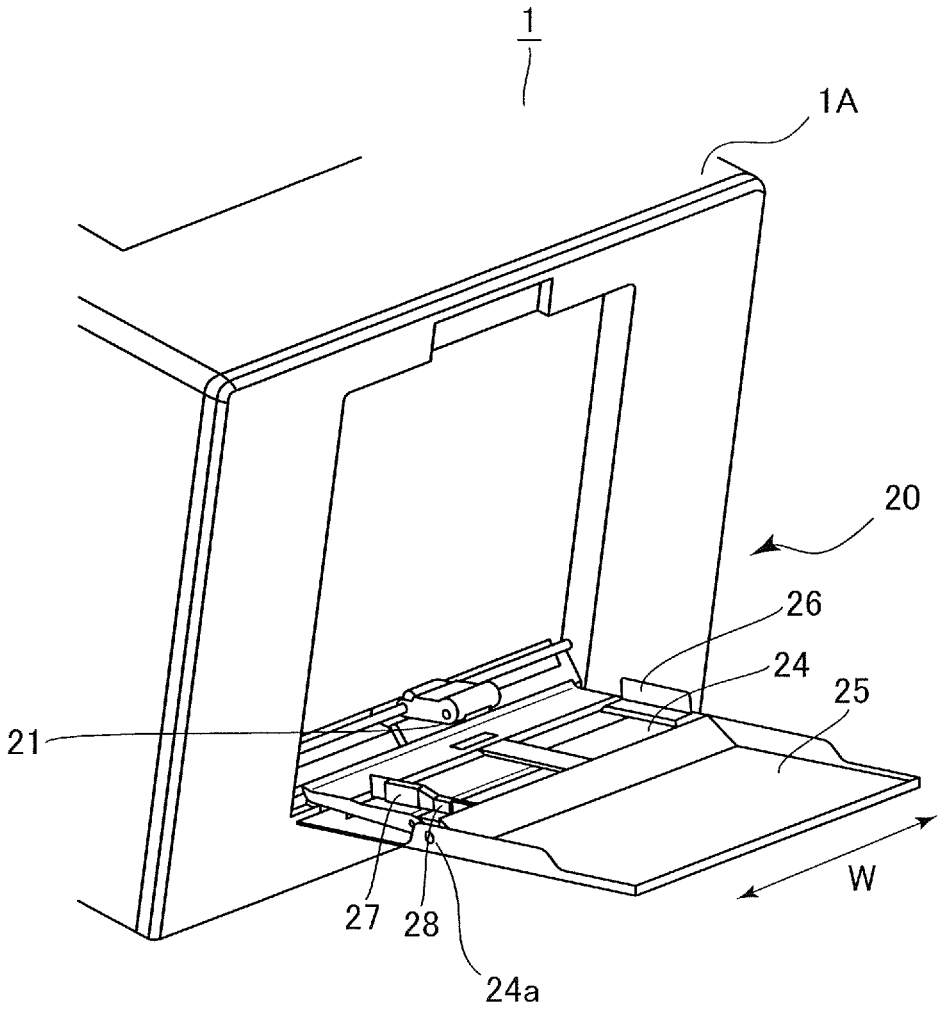
FIG. 2 is a perspective view illustrating a manual feed unit of the printer.

Next, a detailed structure of the manual feed unit 20 will be described. As illustrated in FIG. 2, the cover 25 is supported openably by the apparatus body 1A and the manual feed tray 24 is supported by the cover 25 liftably around a pivot shaft 24*a*. The manual feed tray 24 is lifted up by a lift mechanism not illustrated when a job of feeding the sheet is inputted from the manual feed unit 20 to bring an uppermost sheet stacked on the manual feed tray 24 to come into contact with the feed roller 21.

Figure 3A:
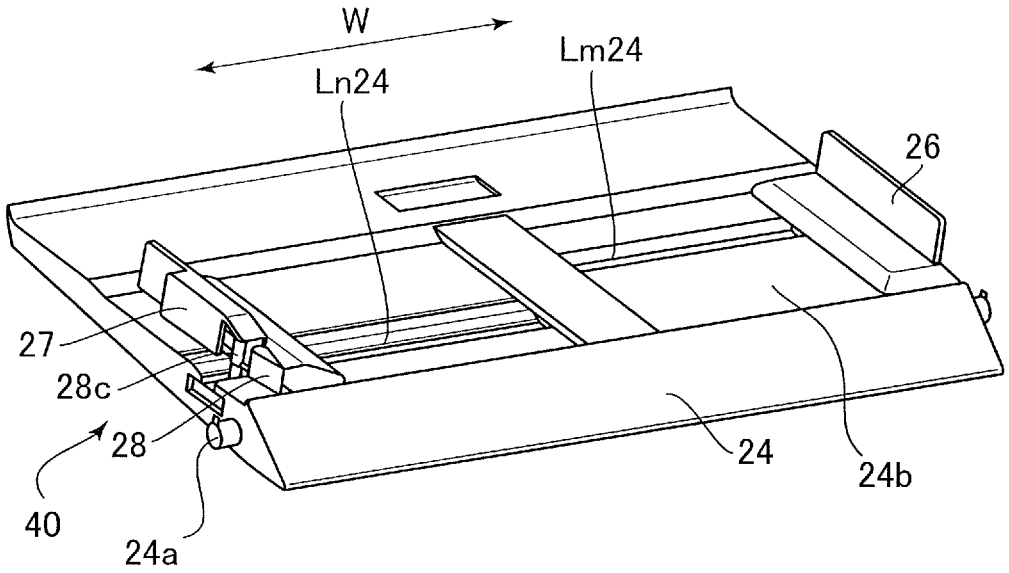
FIG. 3A is a perspective view illustrating an upper surface of the manual feed unit.

As illustrated in FIGS. 2 and 3A, a pair of side regulating plates 26 and 27 is supported by the manual feed tray 24 movably in a width direction W as a moving direction orthogonal to a sheet feeding direction. Guide grooves Lm24 and Ln24 are defined on the manual feed tray 24, and the side regulating plates 26 and 27 are guided by the guide grooves Lm24 and Ln24 in the width direction.

Figure 3B:
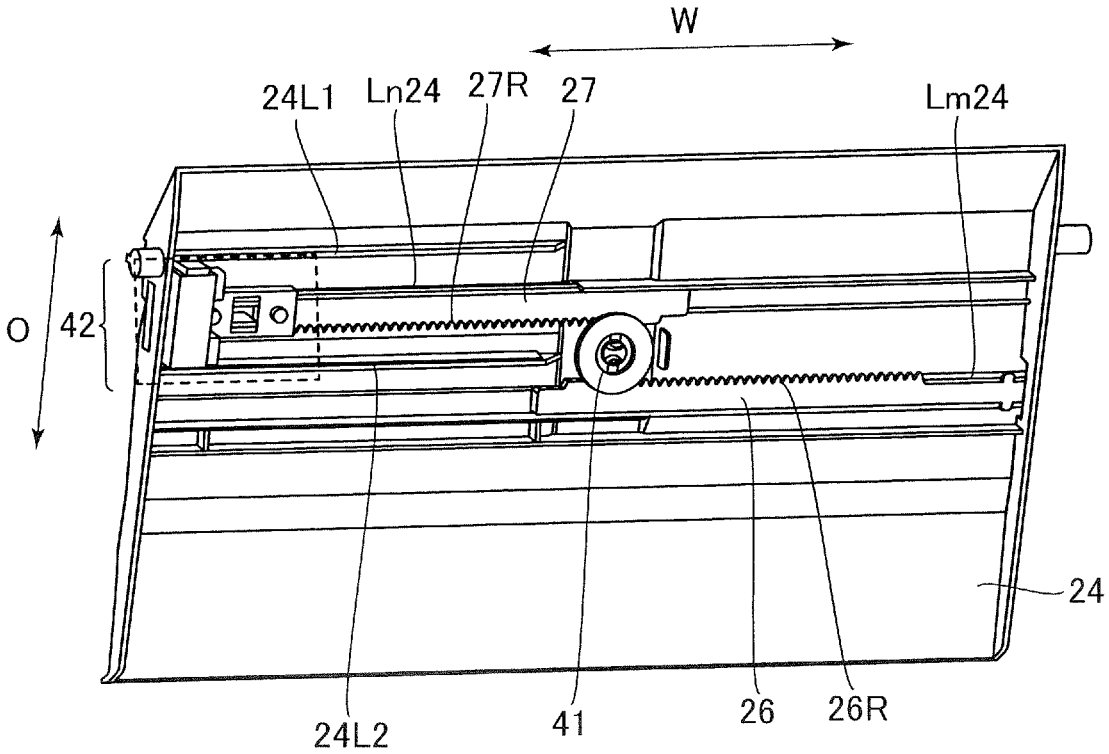
FIG. 3B is a perspective view illustrating a bottom surface including an interlocking mechanism of side regulating plates.

Still further, as illustrated in FIGS. 3A and 3B, the side regulating plates 26 and 27 include rack portions 26R and 27R that extend in the width direction W of a sheet placing face 24*b* on sides opposite from the sheet placing face 24*b* of the manual feed tray 24. These rack portions 26R and 27R engage via a pinion gear 41. Due to that, the side regulating plates 26 and 27 are configured to be interlocked with each other in opposite directions.

The manual feed unit 20 also includes a positioning unit 40 configured to lock the side regulating plates 26 and 27 by positioning the side regulating plate 27 serving as the regulating portion with respect to the manual feed tray 24. Note that the positioning unit 40 may be arranged so as to position the side regulating plate 26 with respect to the manual feed tray 24.

Positioning Unit

Next, the positioning unit 40 will be described. As illustrated in FIG. 3B, the positioning unit 40 includes a pair of rack gears 24L1 and 24L2 formed on the manual feed tray 24 and a lock mechanism 42. The rack gears 24L1 and 24L2 are disposed so as to face with each other while interposing the lock mechanism 42, and teeth of the rack gears 24L1 and 24L2 are arrayed in the width direction. That is, the rack gear 24L2 serving as a second teeth portion is disposed at a position different from that of the rack gear 24L1 serving as a first teeth portion in an orthogonal direction O orthogonal to the width direction.

Figure 4A:
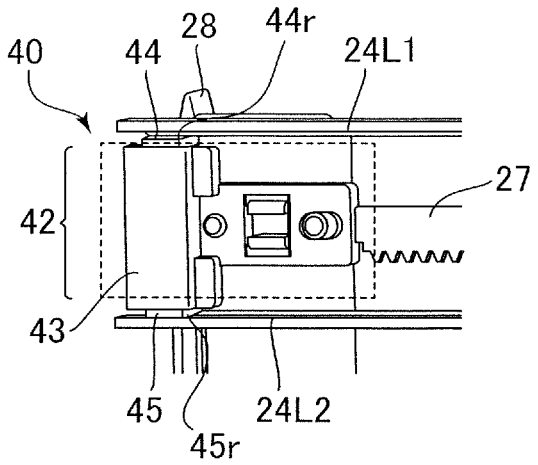
FIG. 4A is a perspective view illustrating a positioning unit.
Figure 4B:
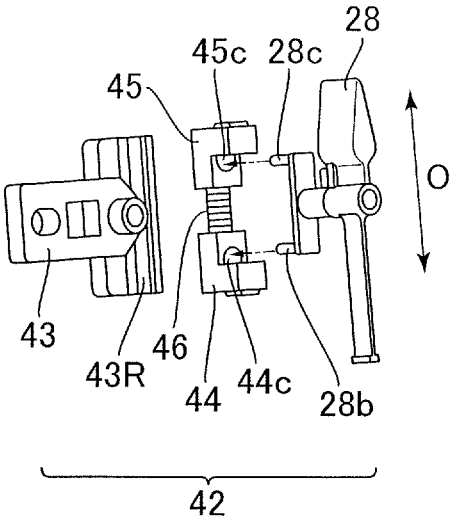
FIG. 4B is an exploded perspective view illustrating the positioning unit.

As illustrated in FIGS. 4A and 4B, the lock mechanism 42 includes an anchor holder 43 connected to the side regulating plate 27 through the guide groove Ln24 (see FIG. 3A) and anchors 44 and 45 held by a holding portion 43R of the anchor holder 43. The lock mechanism 42 also includes a lock releasing lever 28 connected with the anchors 44 and 45 and a compression spring 46 compressed between the anchors 44 and 45. The anchors 44 and 45 are supported by the holding portion 43R slidably in the orthogonal direction O.

Cam holes 44*c* and 45*c* are defined respectively through the anchors 44 and 45 to insert boss portions 28*b* and 28*c* of the lock releasing lever 28. While the anchors 44 and 45 are urged by the compression spring 46 in a direction of separating from each other, the boss portions 28*b* and 28*c* of the lock releasing lever 28 restrict moves of the anchors 44 and 45. The cam holes 44*c* and 45*c* of the anchors 44 and 45 are defined to be larger than the boss portions 28*b* and 28*c* such that the boss portions 28*b* and 28*c* are movable by a predetermined distance within the cam holes 44*c* and 45*c*.

Figure 4C:
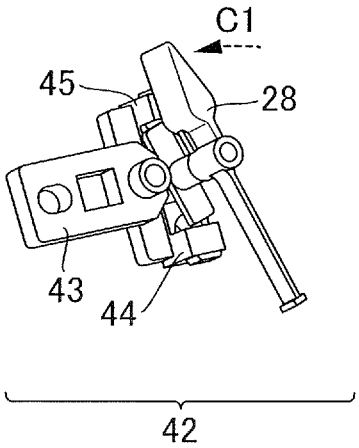
FIG. 4C is a perspective view illustrating an operation of a lock mechanism.
Figure 4D:
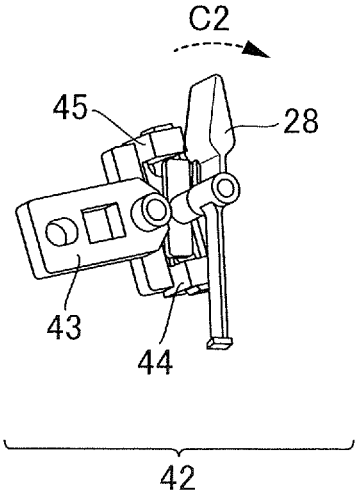
FIG. 4D is a perspective view illustrating the operation of the lock mechanism.

As illustrated in FIGS. 4C and 4D, if the lock releasing lever 28 is turned in directions of arrows C1 and C2, the anchors 44 and 45 approach with each other against an urging force of the compression spring 46 by the engagements of the boss portions 28*b* and 28*c* with the cam holes 44*c* and 45*c*. The anchors 44 and 45 are provided with teeth portions 44*r* and 45*r* (see FIG. 5A) described later, and it is possible to unlock the rack gears 24L1 and 24L2 with the teeth portions 44*r* and 45*r* by turning the lock releasing lever 28 serving as a separation mechanism. Thereby, a user can move the side regulating plate 27.

Note that the compression spring 46 serving as an urging portion urges the teeth portion 44*r* serving as a third teeth portion to engage with the rack gear 24L1 and also urges the teeth portion 45*r* serving as a fourth teeth portion to engage with the rack gear 24L2. The teeth portions 44*r* and 45*r* are configured to respectively engage with the rack gears 24L1 and 24L2 in the orthogonal direction O.

Anchor and Tooth-Shape of Lack Gear

Figure 5A:
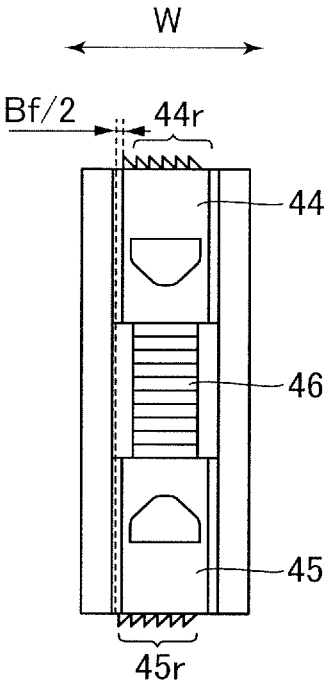
FIG. 5A is a section view illustrating a pair of anchors.
Figure 5B:
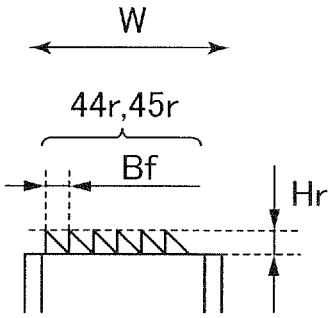
FIG. 5B is an enlarged section view illustrating a teeth portion.

Next, tooth-shapes of the anchors 44 and 45 and the rack gears 24L1 and 24L2 will be described. As illustrated in FIG. 5A, the anchors 44 and 45 are provided with teeth portions 44*r* and 45*r* engageable with the rack gears 24L1 and 24L2. As illustrated in FIG. 5B, the teeth portions 44*r* and 45*r* have a plurality of teeth arrayed in the width direction W with a predetermined pitch Bf, respectively. These teeth have an approximately right angled triangle shape and a tooth depth from a bottom to a tip is a length Hr. Still further, as illustrated in FIG. 5A, the teeth of the teeth portion 44*r* and the teeth portion 45*r* are disposed so as to be shifted from each other in the width direction W by a distance Bf/2 which is a half of the pitch Bf.

Figure 6A:
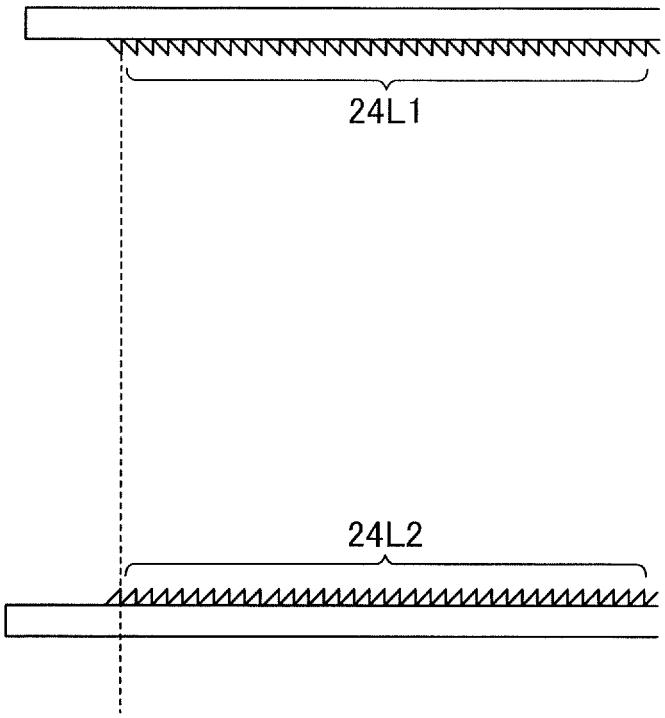
FIG. 6A is a section view illustrating a rack gear.
Figure 6B:
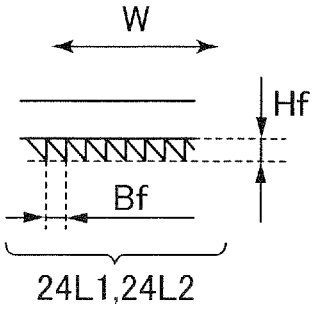
FIG. 6B is an enlarged section view illustrating the rack gear.

As illustrated in FIG. 6B, the rack gears 24L1 and 24L2 have teeth arrayed in the width direction W by a predetermined pitch Bf. These teeth have an approximately right angled triangle shape and a tooth depth from a bottom to a tip is a length Hf. Still further, as illustrated in FIG. 6A, the teeth of the rack gears 24L1 and 24L2 are disposed at the same position from each other in the width direction W.

Operation of Lock Mechanism

Figure 7A:
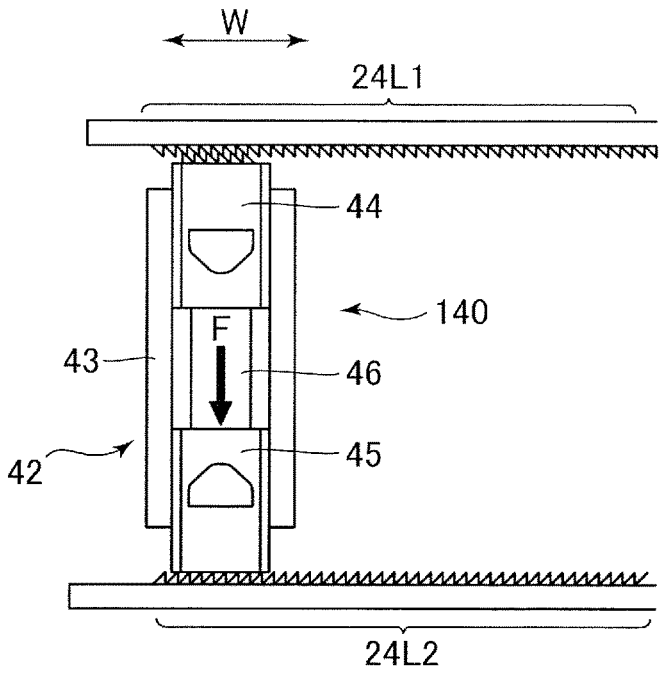
FIG. 7A is a section view illustrating one exemplary state in which the lock mechanism is locked by the rack gear.
Figure 7B:
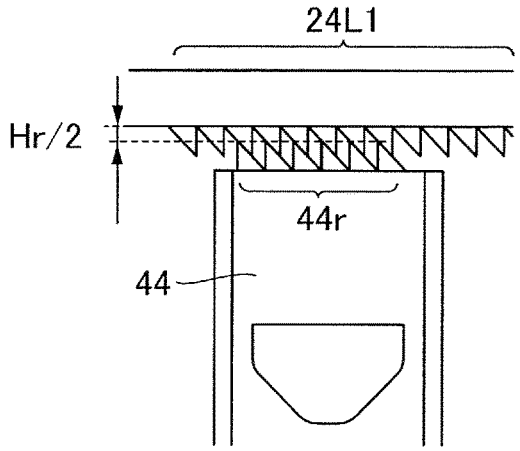
FIG. 7B is an enlarged section view illustrating an engaged part where one anchor is engaged with the rack gear.

Next, an operation of the lock mechanism 42 will be described below. FIG. 7A is a section view illustrating one exemplary state in which the lock mechanism 42 is locked by the rack gears 24L1 and 24L2. FIG. 7B is an enlarged section view illustrating an engaged part where one anchor 44 is engaged with the rack gear 24L1 and FIG. 7C is an enlarged section view illustrating an engaged part where the other anchor 45 is engaged with the rack gear 24L2.

As described above, while the teeth portions 44*r* and 45*r* of the anchors 44 and 45 are disposed so as to be shifted from each other by the distance Bf/2, the rack gears 24L1 and 24L2 are disposed at the same position in the width direction W. Due to that, the teeth portions 44*r* and 45*r* are not both engaged with the rack gears 24L1 and 24L2 at a time.

Figure 7C:
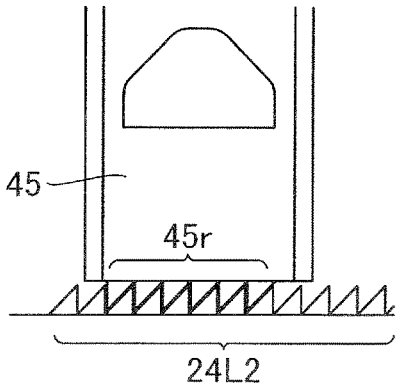
FIG. 7C is an enlarged section view illustrating an engaged part where another anchor is engaged with the rack gear.

For instance, when the teeth portion 45*r* is engaged with the rack gear 24L2, the teeth portion 44*r* is disengaged with the rack gear 24L1 as illustrated in FIGS. 7A through 7C. The engaging state as a third state of the teeth portion 45*r* is a state in which the teeth portion 45*r* is engaged with the rack gear 24L2 to a root of the teeth portion 45*r*. The disengaged state as a fourth state of the teeth portion 45*r* is a state in which the root of 45*r* is not engaged with the rack gear 24L2. That is, the teeth portion 45*r* in the disengaged state engages with less area of the rack gear 24L2 than that in the engaging state.

In the same manner, the engaging state as a first state of the teeth portion 44*r* is a state in which the teeth portion 44*r* is engaged with the rack gear 24L1 to a root of the teeth portion 44*r*. The disengaged state as a second state of the teeth portion 44*r* is a state in which the root of 44*r* is not engaged with the rack gear 24L1. That is, the teeth portion 44*r* in the disengaged state engages with less area of the rack gear 24L1 than that in the engaging state. Thus, the teeth portions 44*r* and 45*r* are capable of transiting respectively from the engaging state and the disengaged state.

As illustrated in FIGS. 7B and 7C, in a case where the teeth portion 44*r* is in the disengaged state and the teeth portion 45*r* in the engaging state, the teeth portion 44*r* is in a state in which the teeth portion 44*r* is raised from the rack gear 24L1 by about the distance Hr/2. Because the teeth portion 44*r* is raised from the rack gear 24L1 by about the distance Hr/2, the anchor 44 approaches to the anchor 45, and the compression spring 46 is compressed by that amount. Then, due to an elastic force accumulated in the compression spring 46, the anchor 45 is pressed against the rack gear 24L2.

That is, a force which the teeth portion 44*r* receives from the rack gear 24L1 acts as a force in a direction in which the teeth portion 45*r* engages with the rack gear 24L2 through the compression spring 46 connecting the anchors 44 and 45. In other words, the compression spring 46 urges the teeth portion 45*r* so as to engage with the rack gear 24L2 by the force the teeth portion 44*r* receives from the rack gear 24L1. Due to that, because rattling between the teeth portion 45*r* and the rack gear 24L2 is reduced, the teeth portion 45*r* engages with the rack gear 24L2 more firmly and the side regulating plates 26 and 27 can be positioned stably to the manual feed tray 24. It is thus possible to improve alignment of the sheet and to reduce conveyance failure or the like by positioning the side regulating plats 26 and 27 firmly to the manual feed tray 24.

Note that the anchors 44 and 45 and the compression spring 46 composes an operating portion 140 that causes the force which the teeth portion 44*r* receives from the rack gear 24L1 to act as the force in a direction in which the teeth portion 45*r* engages with the rack gear 24L2. Still further, when the teeth portion 45*r* is in the disengaged state, the operating portion 140 acts such that the force which the teeth portion 45*r* receives from the rack gear 24L2 acts as the force in a direction in which the teeth portion 44*r* engages with the rack gear 24L1. In other words, the compression spring 46 urges such that the teeth portion 44*r* is engaged with the rack gear 24L1 by the force which the teeth portion 45*r* receives from the rack gear 24L2. This arrangement makes it possible to position the side regulating plate 27 firmly to the manual feed tray 24 even if either one of the teeth portions 44*r* and 45*r* is engaged with the rack gear.

Still further, because the teeth portions 44*r* and 45*r* of the anchors 44 and 45 are disposed so as to shift from each other by the distance Bf/2, the teeth portion 44*r* is put into the engaging state and the teeth portion 45*r* is put into the disengaged state if the side regulating plate 27 moves by the distance Bf/2 in the width direction W. This arrangement makes it possible to position the side regulating plate 27 to the manual feed tray 24 per every distance Bf/2 which is thinner than the pitch Bf of the respective teeth portions 44*r* and 45*r*.

The pitches of teeth portions 44*r* and 45*r* are limited in machining size and mechanical strength in particular and if the pitch Bf is reduced, the depth of the tooth is shortened. If the depth of the tooth is shortened, engagement strength of the teeth portions 44*r* and 45*r* with the rack gears 24L1 and 24L2 drops. Then, according to the present embodiment, the pairs of the rack gears and the teeth portions are provided and the pair of teeth portions is disposed so as to be shifted from each other by the distance Bf/2 to be able to position the side regulating plate 27 more finely while keeping the engagement strength of the teeth portions. Note that the pair of rack gears may be disposed so as to be shifted from each other by the distance Bf/2 and the pair of teeth portions may be provided at the same position in the width direction W.

Second Embodiment

While a second embodiment of the present disclosure will be described below, the second embodiment is a modification of the lock mechanism of the first embodiment. Therefore, the same component parts with those of the first embodiment will not be illustrated in the drawing or will be described by denoting the same reference numerals.

Lock Mechanism

Figure 8A:
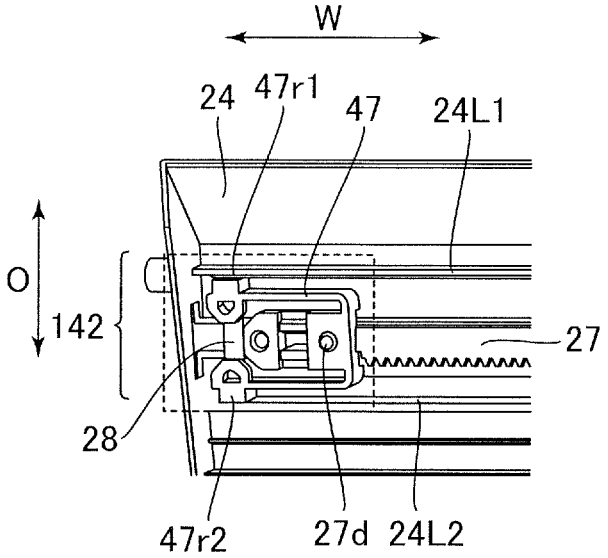
FIG. 8A is a perspective view illustrating a lock mechanism according to a second embodiment of the present disclosure.
Figure 8B:
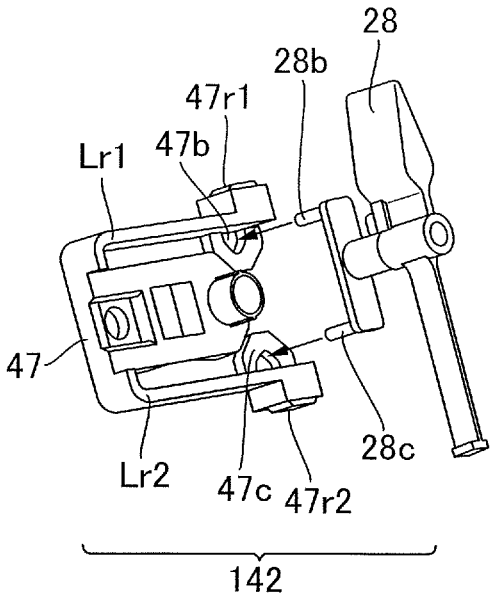
FIG. 8B is an exploded perspective view illustrating the lock mechanism.

As illustrated in FIGS. 8A and 8B, a lock mechanism 142 of the present embodiment includes an anchor member 47 and a lock releasing lever 28. The anchor member 47 serving as an operating portion and a holding portion is supported pivotably around a shaft portion 27*d* provided on the manual feed tray 24 and includes anchor arms Lr1 and Lr2 which are elastic by being thinly formed. The shaft portion 27*d* serving as a pivot shaft extends in a direction perpendicular to the width direction W and the orthogonal direction O.

A teeth portion 47*r*1 serving as a third teeth portion capable of engaging with the rack gear 24L1 is provided at an edge portion of the anchor arm Lr1 and a teeth portion 47*r*2 serving as a fourth teeth portion capable of engaging with the rack gear 24L2 is provided at an edge portion of the anchor arm Lr2. The anchor arms Lr1 and Lr2 serving as an urging portion urge such that teeth portions 47*r*1 and 47*r*2 engage with the rack gears 24L1 and 24L2, respectively. More specifically, the anchor arm Lr1 serving as a first elastic portion is provided on the anchor member 47 and moves the teeth portion 47*r*1 in the orthogonal direction O by elastically deforming in the orthogonal direction O. The anchor arm Lr2 serving as a second elastic portion is provided on the anchor member 47 and moves the teeth portion 47*r*2 in the orthogonal direction O by elastically deforming in the orthogonal direction O. The teeth portions 47*r*1 and 47*r*2 are both disposed on one side of the shaft portion 27*d* in the width direction W when viewed in an axial direction of the shaft portion 27*d*.

A cam hole 47*b* is defined on a side opposite from the teeth portion 47*r*1 of the anchor arm Lr1 and a cam hole 47*c* is defined on a side opposite from the teeth portion 47*r*2 of the anchor arm Lr2. The boss portions 28*b* and 28*c* of the lock releasing lever 28 are inserted into the cam holes 47*b* and 47*c*. The cam holes 47*c* and 47*c* are defined to be larger than the boss portions 28*b* and 28*c* such that the boss portions 28*b* and 28*c* are movable by a predetermined distance within the cam holes 47*b* and 47*c*.

Figure 8C:
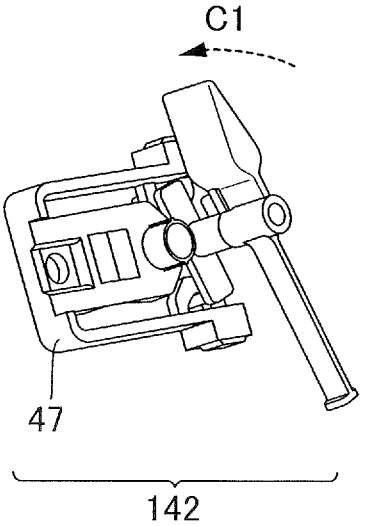
FIG. 8C is a perspective view illustrating an operation of the lock mechanism.
Figure 8D:
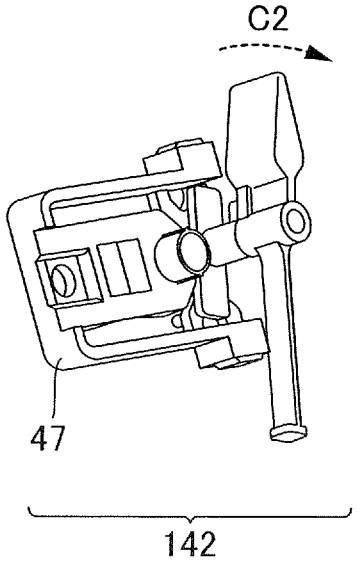
FIG. 8D is a perspective view illustrating the operation of the lock mechanism.

As illustrated in FIGS. 8C and 8D, if the lock releasing lever 28 is turned in a direction of an arrow C1 or an arrow C2, the anchor arms Lr1 and Lr2 of the anchor member 47 approach with each other by the engagement of the boss portions 28*b* and 28*c* with the cam holes 47*b* and 47*c*. It is possible to unlock the rack gears 24L1 and 24L2 with the teeth portions 47*r*1 and 47*r*2 by thus turnably operating the lock releasing lever 28. Thereby, the user can move the side regulating plate 27.

Tooth-Shape of Anchor Member

Figure 9A:
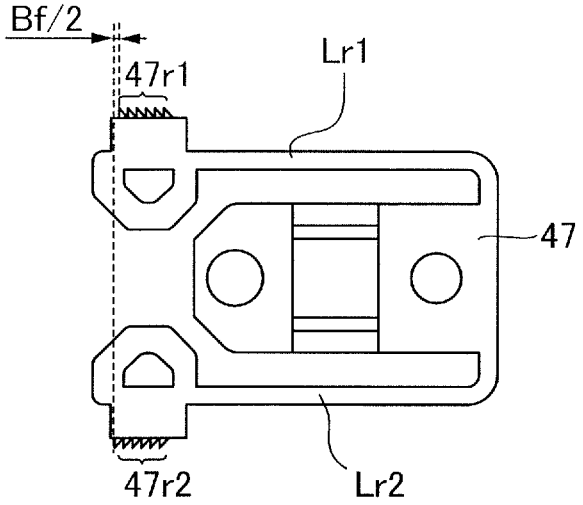
FIG. 9A is a section view illustrating an anchor member.
Figure 9B:
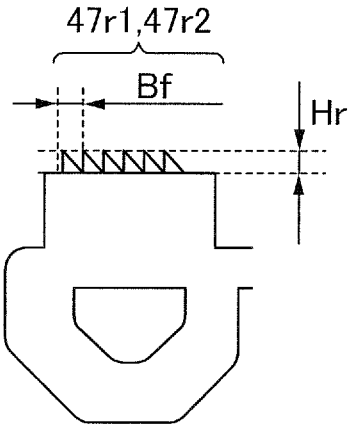
FIG. 9B is an enlarged section view illustrating a teeth portion.

Next, a tooth-shape of the anchor 47 will be described. As illustrated in FIG. 9A, the anchor 47 is provided with teeth portions 47*r*1 and 47*r*2 engageable with the rack gears 24L1 and 24L2. As illustrated in FIG. 9B, the teeth portions 47*r*1 and 47*r*2 have a plurality of teeth arrayed in the width direction W with a predetermined pitch Bf, respectively. These teeth have an approximately right angled triangle shape and a tooth depth from a bottom to a tip is a length Hr. Still further, as illustrated in FIG. 9A, the teeth of the teeth portion 47*r*1 and the teeth portion 47*r*2 are disposed so as to be shifted from each other in the width direction W by a distance Bf/2 which is a half of the pitch Bf.

Operation of Lock Mechanism

Figure 10A:
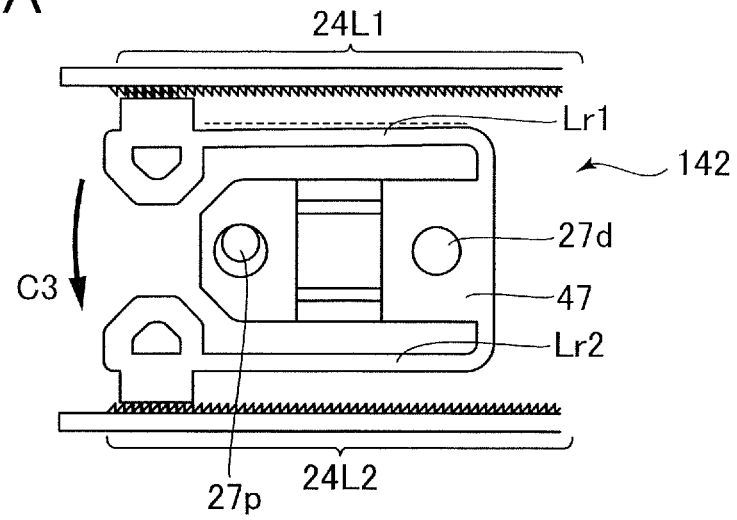
FIG. 10A is a section view illustrating an exemplary state in which the lock mechanism is locked by the rack gear.
Figure 10B:
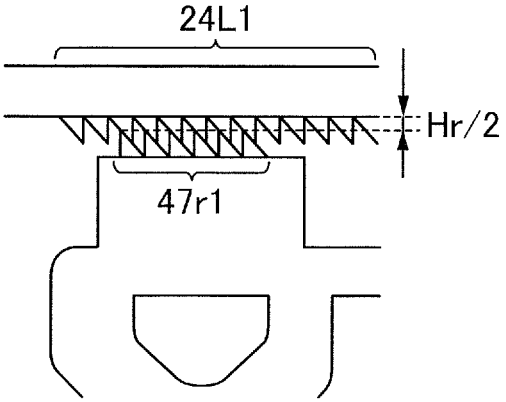
FIG. 10B is an enlarged section view illustrating an engaged part where one teeth portion is engaged with the rack gear.

Next, an operation of a lock mechanism 142 will be described below. FIG. 10A is a section view illustrating one exemplary state in which the lock mechanism 142 is locked by the rack gears 24L1 and 24L2. FIG. 10B is an enlarged section view illustrating an engaged part where one anchor arm Lr1 is engaged with the rack gear 24L1 and FIG. 10C is an enlarged section view illustrating an engaged part where the other anchor arm Lr2 is engaged with the rack gear 24L2.

As described above, while the teeth portions 47*r*1 and 47*r*2 of the anchor arms Lr1 and Lr2 are disposed so as to be shifted from each other by the distance Bf/2, the rack gears 24L1 and 24L2 are disposed at the same position in the width direction W. Due to that, the teeth portions 47*r*1 and 47*r*2 are not both engaged with the rack gears 24L1 and 24L2 at a time.

Figure 10C:
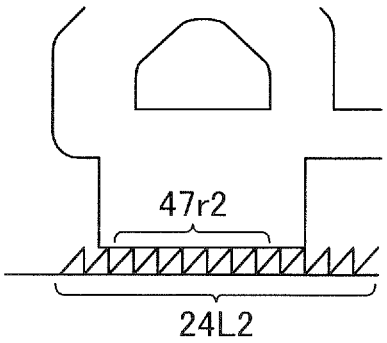
FIG. 10C is an enlarged section view illustrating an engaged part where another teeth portion is engaged with the rack gear.

As illustrated in FIGS. 10A, 10B and 10C, in a case where the teeth portion 47*r*1 is in the disengaged state and the teeth portion 47*r*2 is in the engaging state, the teeth portion 47*r*1 is in a state of being raised from the rack gear 24L1 by about the distance Hr/2. The anchor arm Lr1 elastically deforms so as to approach to the anchor arm Lr2 because the teeth portion 47*r*1 is raised from the rack gear 24L1 by about the distance Hr/2. The elastic force accumulated in the anchor arm Lr1 tries to turn the anchor member 47 in a direction of an arrow C3 around the shaft portion 27*d*. Thereby, the teeth portion 47*r*2 provided on the anchor arm Lr2 is pressed against the rack gear 24L2.

That is, a force which the teeth portion 47*r*1 receives from the rack gear 24L1 acts as a force in a direction in which the teeth portion 47*r*2 engages with the rack gear 24L2 through the anchor member 47. In other words, the anchor arm Lr1 urges the teeth portion 47*r*2 so as to engage with the rack gear 24L2 by the force which the teeth portion 47*r*1 receives from the rack gear 24L1. Still further, in a case where the teeth portion 47*r*1 is in the engaging state and the teeth portion 47*r*2 is in the disengaged state, the anchor arm Lr2 urges the teeth portion 47*r*1 so as to engage with the rack gear 24L1 by the force which the teeth portion 47*r*2 receives from the rack gear 24L2.

Due to that, the teeth portion 47*r*2 engages with the rack gear 24L2 more firmly and the side regulating plates 26 and 27 can be stably positioned to the manual feed tray 24. Still further, because the teeth portions 47*r*1 and 47*r*2 are both provided on one anchor member 47, it is possible to cut a number of component parts and the costs.

Third Embodiment

While a third embodiment of the present disclosure will be described below, the third embodiment is a modification of the lock mechanism and the disposition of the rack gear of the first embodiment. Therefore, the same component parts with those of the first embodiment will not be illustrated in the drawing or will be described by denoting the same reference numerals.

Lock Mechanism

Figure 11A:
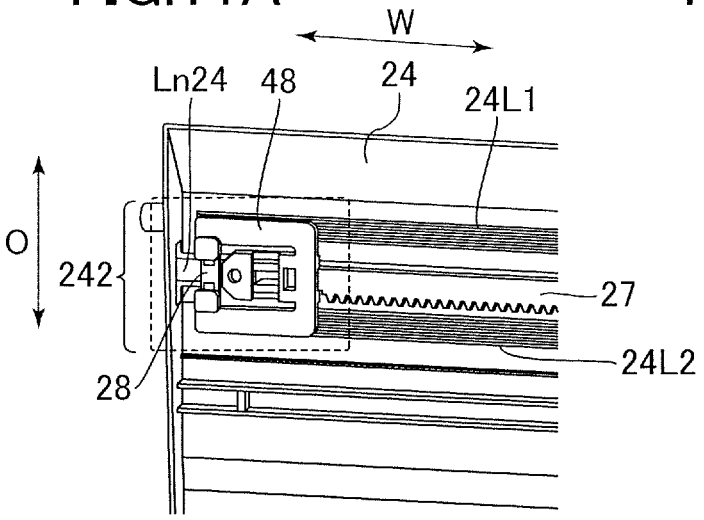
FIG. 11A is a perspective view illustrating a lock mechanism according to a third embodiment of the present disclosure.
Figure 11B:
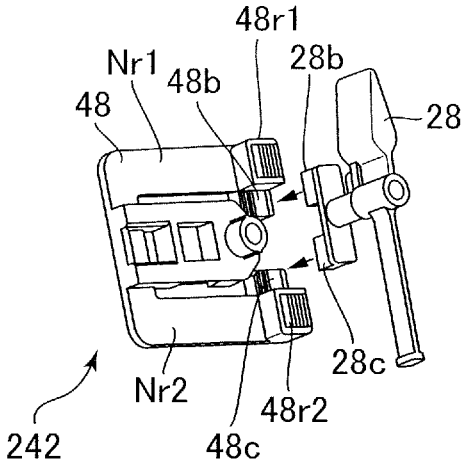
FIG. 11B is an exploded perspective view illustrating the lock mechanism.

As illustrated in FIGS. 11A and 11B, a lock mechanism 242 of the present embodiment includes an anchor member 48 connected to the side regulating plate 27 through a guide groove Ln24 and the lock releasing lever 28. The rack gears 24L1 and 24L2 provided on the manual feed tray 24 are disposed at positions different from each other in the orthogonal direction O orthogonal to the width direction W while interposing the guide groove Ln24 serving as a guide portion.

The anchor member 48 serving as an operating portion and a holding portion includes anchor arms Nr1 and Nr2 which are elastic by being thinly formed. A teeth portion 48*r*1 serving as a third teeth portion engageable with the rack gear 24L1 is provided at an edge portion of the anchor arm Nr1 and a teeth portion 48*r*2 serving as a fourth teeth portion engageable with the rack gear 24L2 is provided at an edge portion of the anchor arm Nr2. The teeth portions 48*r*1 and 48*r*2 engage with the rack gears 24L1 and 24L2, respectively, in a direction perpendicular to the width direction W and the orthogonal direction O. The anchor arms Nr1 and Nr2 serving as an urging portion urge the teeth portions 48*r*1 and 48*r*2 to engage with the rack gears 24L1 and 24L2, respectively. More specifically, the anchor arm Nr1 serving as a third elastic portion is provided on the anchor member 48 and moves the teeth portion 48*r*1 in an engage direction E by elastically deforming in the engage direction E orthogonal to the width direction W and the orthogonal direction O. The anchor arm Nr2 serving as a fourth elastic portion is provided on the anchor member 48 to move the teeth portion 48*r*2 in the engage direction E by elastically deforming in the engage direction E.

Figure 11C:
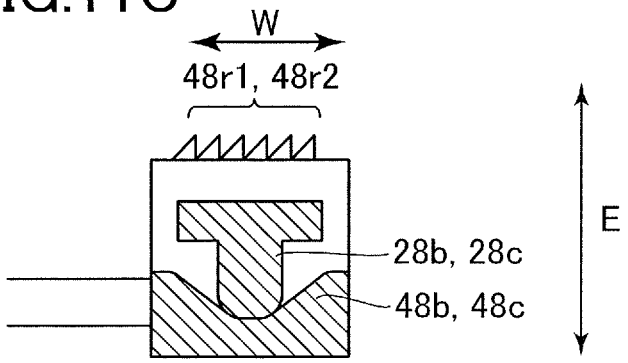
FIG. 11C is an enlarged section view illustrating shapes of a cam groove and a boss portion.

Still further, the anchor arm Nr1 is provided with a cam groove 48*b*, and the anchor arm Nr2 is provided with a cam groove 48*c*. Boss portions 28*b* and 28*c* of the lock releasing lever 28 engage with the cam grooves 48*b* and 48*c*. As illustrated in FIG. 11C, the cam grooves 48*b* and 48*c* have a groove shape recessed when viewed in the orthogonal direction O, and the boss portions 28*b* and 28*c* press the cam grooves 48*b* and 48*c* by moving in the width direction while engaging with the cam grooves 48*b* and 48*c*.

Figure 11D:
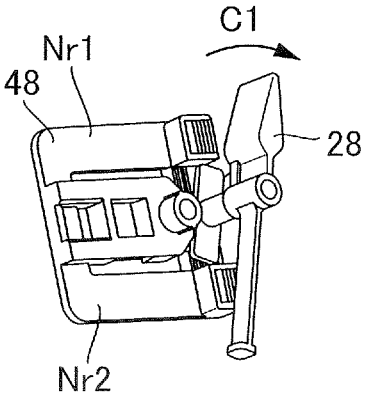
FIG. 11D is a perspective view illustrating an operation of the lock mechanism.
Figure 11E:
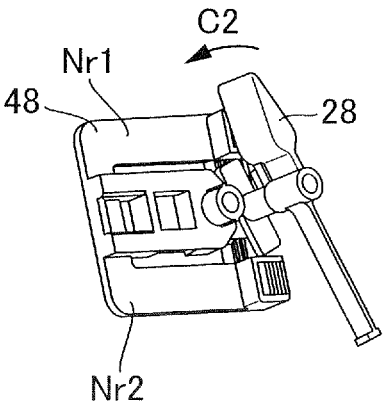
FIG. 11E is a perspective view illustrating the operation of the lock mechanism.

As illustrated in FIGS. 11D and 11E, if the lock releasing lever 28 is turned in a direction of an arrow C1 or of an arrow C2, the anchor arms Nr1 and Nr2 of the anchor member 48 press the cam grooves 48*b* and 48*c*. Thereby, the teeth portions 48*r*1 and 48*r*2 of the anchor arms Nr1 and Nr2 separate from the rack gears 24L1 and 24L2 and the anchor 44 of the rack gears 24L1 and 24L2, and the teeth portions 48*r*1 and 48*r*2 are unlocked from the rack gears 24L1 and 24L2. Thereby, the user can move the side regulating plate 27.

Anchor Member and Tooth-Shape of Lack Gear

Figure 12A:
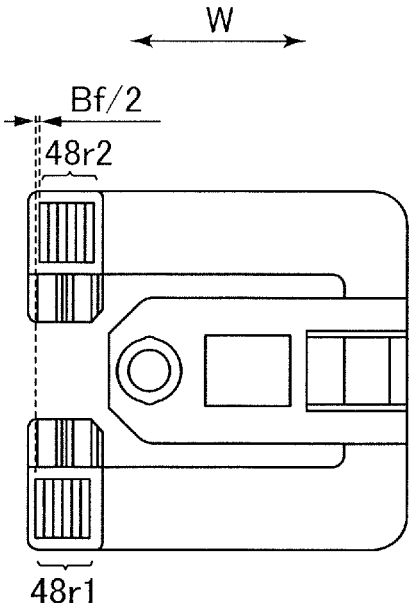
FIG. 12A is a section view illustrating an anchor member of the third embodiment.
Figure 12B:
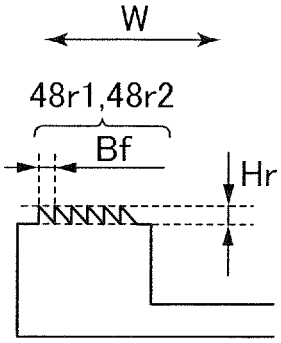
FIG. 12B is an enlarged section view illustrating a teeth portion.

Next, a tooth-shape of the anchor member 48 and the rack gears 24L1 and 24L2 will be described. As illustrated in FIG. 12A, the anchor member 48 is provided with teeth portions 48*r*1 and 48*r*2 engageable with the rack gears 24L1 and 24L2. As illustrated in FIG. 12B, the teeth portions 48*r*1 and 48*r*2 have a plurality of teeth arrayed in the width direction W with a predetermined pitch Bf, respectively. These teeth have an approximately right angled triangle shape and a tooth depth from a bottom to a tip is a length Hr. Still further, as illustrated in FIG. 12A, the teeth of the teeth portion 48r1 and the teeth portion 48r2 are disposed so as to be shifted from each other in the width direction W by the distance Bf/2 which is a half of the pitch Bf.

Figure 13A:
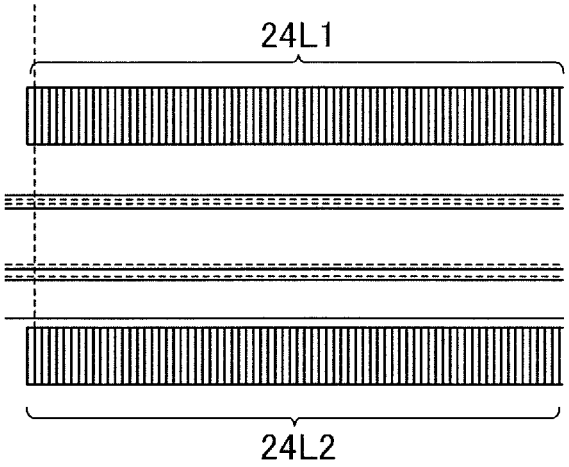
FIG. 13A is a section view illustrating a rack gear of the third embodiment.
Figure 13B:
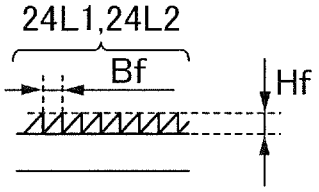
FIG. 13B is an enlarged section view illustrating the rack gear.

As illustrated in FIG. 13B, the rack gears 24L1 and 24L2 have a plurality of teeth arrayed in the width direction W with a predetermined pitch Bf. These teeth have an approximately right angled triangle shape, and a tooth depth from a bottom to a tip is a length Hf. Still further, as illustrated in FIG. 13A, the teeth of the rack gears 24L1 and 24L2 are disposed at the same position from each other in the width direction W.

Operation of Lock Mechanism

Next, an operation of the lock mechanism 242 will be described. As described above, while the teeth portions 48r1 and 48r2 of the anchor arms Nr1 and Nr2 are disposed so as to be shifted from each other by the distance Bf/2, the rack gears 24L1 and 24L2 are disposed at the same position in the width direction W. Due to that, the teeth portions 48r1 and 48r2 are not both engaged with the rack gears 24L1 and 24L2 at a time.

Figure 14A:
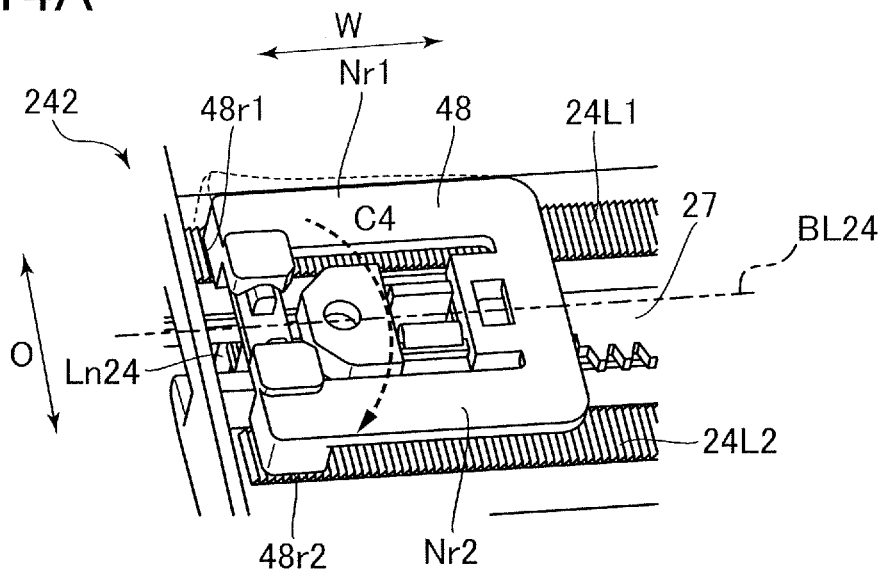
FIG. 14A is a section view illustrating one exemplary state in which the lock mechanism is locked by the rack gear.
Figure 14B:
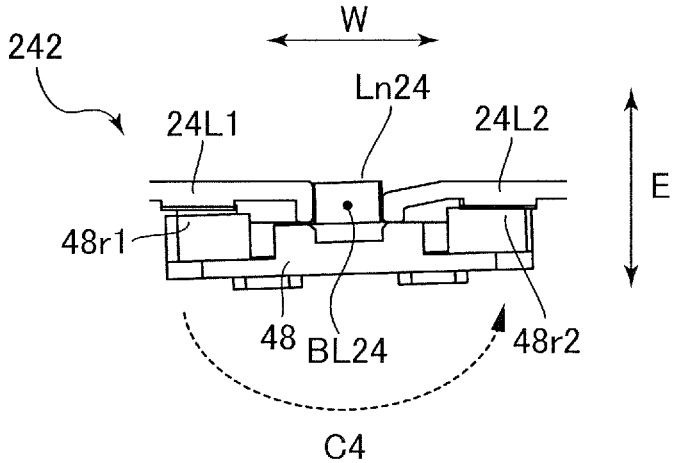
FIG. 14B is a section view illustrating a state in which the anchor member swings.
Figure 14C:
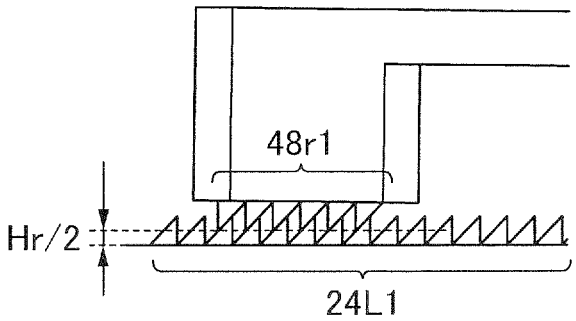
FIG. 14C is an enlarged section view illustrating an engaged part where one teeth portion engages with the rack gear.
Figure 14D:
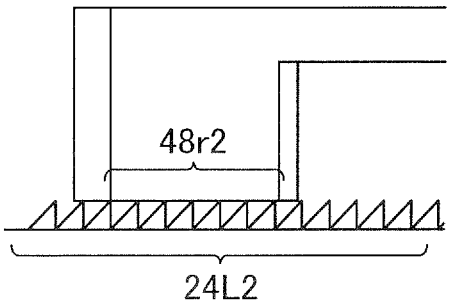
FIG. 14D is an enlarged section view illustrating an engaged part where another teeth portion engages with the rack gear.

As illustrated in FIGS. 14A through 14D, in a case where the teeth portion 48r1 is in the disengaged state and the teeth portion 48r2 is in the engaging state, the teeth portion 48r1 is raised from the rack gear 24L1 by about the distance Hr/2. Here, as illustrated in FIGS. 14A and 14B, the anchor member 48 is attached to the side regulating plate 27 so as to be swingable around an axis BL24 extending in the width direction W. The teeth portions 48r1 and 48r2 are disposed so as to sandwich the axis BL24 in term of the orthogonal direction O.

Because the teeth portion 48r1 is raised from the rack gear 24L1 by about the distance Hr/2, the anchor arm Nr1 elastically deforms in a direction of separating from the rack gear 24L1. An elastic force generated in the anchor arm Nr1 tries to turn the anchor member 48 in a direction of an arrow C4 around the axis BL24. Thereby, the teeth portion 48r2 provided on the anchor arm Nr2 is pressed against the rack gear 24L2.

That is, a force which the teeth portion 48r1 receives from the rack gear 24L1 acts as a force in a direction in which the teeth portion 48r2 engages with the rack gear 24L2 through the anchor member 48. In other words, the anchor arm Nr1 urges the teeth portion 48r2 to engage with the rack gear 24L2 by the force which the teeth portion 48r1 receives from the rack gear 24L1. Still further, in a case where the teeth portion 48r1 is in the engaging state and the teeth portion 48r2 is in the disengaged state, the anchor arm Nr2 urges the teeth portion 48r1 to engage with the rack gear 24L1 by the force which the teeth portion 48r2 receives from the rack gear 24L2.

Therefore, the teeth portion 48r2 can be more firmly engaged with the rack gear 24L2, and the side regulating plates 26 and 27 can be positioned stably to the manual feed tray 24.

Still further, because both of the teeth portions 48r1 and 48r2 are provided on one anchor member 48 in the present embodiment, it is possible to cut a number of component parts and the costs. Still further, because the teeth portions 48r1 and 48r2 are configured to engage with the rack gears 24L1 and 24L2 in a sheet stacking direction perpendicular to the width direction W and the orthogonal direction O, the lock mechanism 242 can be downsized in the sheet stacking direction.

Note that while the pair of rack gears is disposed at the same position in the width direction W and the pair of teeth portions are disposed so as to be shifted by the distance Bf/2 in all embodiments described above, the present disclosure is not limited to such configuration. For instance, the pair of rack gears may be disposed so as to be shifted in the width direction W by the distance Bf/2 and the pair of teeth portions may be disposed at the same position in the width direction W.

Still further, the distance Bf/2 which is a shift amount of the teeth may be appropriately changed. Still further, three or more rows of rack gears and three or more teeth portions may be provided without being limited to the pair of rack gears and the pair of teeth portions.

Still further, while the present disclosure has been applied to position the side regulating plate 27 of the manual feed unit 20 in any embodiments described above, the present disclosure is not limited to such arrangement. For instance, a rear end regulating plate configured to regulate a rear end position of a sheet may be provided, and the present disclosure may be applied to the rear end regulating plate. The present disclosure is also applicable to the body feed unit 10.

Still further, while all of the embodiments have been described by exemplifying the electro-photographic printer 1, the present disclosure is not limited to such arrangement. For instance, the present disclosure is also applicable to an ink-jet type image forming apparatus configured to form an image on a sheet by discharging ink droplets from a nozzle.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-010374, filed Jan. 24, 2019, which is hereby incorporated by reference herein in its entirety.

What is claimed is:

1. A sheet supporting apparatus comprising:

a sheet support configured to support a sheet;

a regulator movably supported by the sheet support and configured to regulate a position of the sheet supported by the sheet support; and a positioning device configured to position the regulating portion to the sheet support, wherein the positioning device comprises:

a first group of teeth provided on the sheet support, the first group of teeth having a plurality of teeth arranged along a moving direction of the regulator;

a second group of teeth disposed at a position different from the first group of teeth in an orthogonal direction orthogonal to the moving direction and provided on the sheet support, the second group of teeth having a plurality of teeth arranged along the moving direction;

a third group of teeth provided on the regulator and being capable of transiting to a first state of engaging with the first group of teeth and to a second state of engaging with less area of the first group of teeth than that in the first state; and a fourth group of teeth provided on the regulator and being capable of transiting to a third state of engaging with the second group of teeth and to a fourth state of engaging with less area of the second group of teeth than that in the third state, wherein the third group of teeth comprises a plurality of teeth arrayed in the moving direction with a predetermined pitch, wherein the fourth group of teeth comprises a plurality of teeth arrayed in the moving direction with the predetermined pitch and disposed so as to be shifted in the moving direction from the plurality of teeth of the third group of teeth by a half of the predetermined pitch, and wherein the plurality of teeth of the first group of teeth and the plurality of teeth of the second group of teeth are disposed at the same position in the moving direction.

2. The sheet supporting apparatus according to claim 1, where the sheet support comprises a guide disposed between the first and second groups of teeth in the orthogonal direction and configured to guide the regulator in the moving direction.

3. The sheet supporting apparatus according to claim 1, wherein the positioning device includes an operating element configured to cause a force which the fourth group of teeth receives from the second group of teeth to act as a force in a direction in which the third group of teeth engages with the first group of teeth in a case where the third group of teeth is in the first state and the fourth group of teeth is in the fourth state, and configured to cause a force which the third group of teeth receives from the first group of teeth to act as a force in which the fourth group of teeth engages with the second group of teeth in a case where the fourth group of teeth is in the third state and the third group of teeth is in the second state.

4. The sheet supporting apparatus according to claim 3, wherein the operating element comprises an urging member configured to urge the third group of teeth to engage with the first group of teeth and to urge the fourth group of teeth to engage with the second group of teeth.

5. The sheet supporting apparatus according to claim 4, wherein the urging member urges the third group of teeth to engage with the first group of teeth by a force which the fourth group of teeth receives from the second group of teeth in a case where the third group of teeth is in the first state and the fourth group of teeth is in the fourth state, and urges the fourth group of teeth to engage with the second group of teeth by a force which the third group of teeth receives from the first group of teeth in a case where the fourth group of teeth is in the third state and the third group of teeth is in the second state.

6. The sheet supporting apparatus according to claim 4, wherein the third group of teeth and the fourth group of teeth are supported slidably in the orthogonal direction with respect to the regulator and are provided engageably with the first group of teeth and the second group of teeth respectively in the orthogonal direction, and wherein the urging member is a compression spring disposed between the third group of teeth and the fourth group of teeth in the orthogonal direction.

7. The sheet supporting apparatus according to claim 4, wherein the operating element comprises a holder that holds the third and fourth groups of teeth and is supported by the regulator pivotably around a pivot shaft extending in a direction perpendicular to the moving direction and the orthogonal direction, and wherein the third and fourth groups of teeth engage respectively with the first and second groups of teeth in the orthogonal direction and are disposed on one side in the moving direction when viewed in an axial direction of the pivot shaft.

8. The sheet supporting apparatus according to claim 7, wherein the urging member comprises a first elastic member provided in the holder and moves the third group of teeth in the orthogonal direction by elastically deforming in the orthogonal direction, and a second elastic member provided in the holder and moves the fourth group of teeth in the orthogonal direction by elastically deforming in the orthogonal direction.

9. The sheet supporting apparatus according to claim 4, wherein the operating element comprises a holder configured to hold the third and fourth groups of teeth and being swingable around an axis extending in the moving direction, and wherein the third and fourth groups of teeth are disposed so as to engage with the first and second groups of teeth respectively in an engage direction perpendicular to the moving direction and the orthogonal direction, and disposed so as to sandwich the axis in the orthogonal direction.

10. The sheet supporting apparatus according to claim 9, wherein the urging member comprises a third elastic member provided in the holder and moves the third group of teeth in the engage direction by elastically deforming in the engage direction, and a fourth elastic member provided in the holder and moves the fourth group of teeth in the engage direction by elastically deforming in the engage direction.

11. The sheet supporting apparatus according to claim 1, further comprising a separator configured to separate the third and fourth groups of teeth respectively from the first and second groups of teeth.

12. The sheet supporting apparatus according to claim 1, wherein the moving direction is a direction orthogonal to a sheet feeding direction.

13. An image forming apparatus comprising:

the sheet supporting apparatus as set forth in claim 1; and an image forming assembly configured to form an image on a sheet fed from the sheet supporting apparatus.

* * * * *